US007802780B2

(12) United States Patent
Mader et al.

(10) Patent No.: US 7,802,780 B2
(45) Date of Patent: Sep. 28, 2010

(54) METHOD AND DEVICE FOR INSERTING FLAT ARTICLES INTO PRINTED PRODUCTS

(75) Inventors: Carl Conrad Mader, Hittnau (CH); Rudolf Infanger, Hinwil (CH)

(73) Assignee: FERAG AG, Hinwil (CH)

( * ) Notice: Subject to any disclaimer, the term of this patent is extended or adjusted under 35 U.S.C. 154(b) by 636 days.

(21) Appl. No.: 11/577,843

(22) PCT Filed: Oct. 10, 2005

(86) PCT No.: PCT/CH2005/000590

§ 371 (c)(1),
(2), (4) Date: May 17, 2007

(87) PCT Pub. No.: WO2006/045208

PCT Pub. Date: May 4, 2006

(65) Prior Publication Data

US 2009/0115117 A1 May 7, 2009

(30) Foreign Application Priority Data

Oct. 25, 2004 (CH) ..... 1761/04

(51) Int. Cl.
*B65H 29/02* (2006.01)

(52) U.S. Cl. ..... 270/52.25; 270/52.19; 270/52.23

(58) Field of Classification Search ..... 270/52.14, 270/52.19, 52.22, 52.23, 52.25; 271/379, 271/867.1, 803.4, 803.1, 803.13, 82, 204, 271/206; 198/82, 204, 206, 379, 867.1, 803.4, 198/803.1, 803.13

See application file for complete search history.

(56) References Cited

U.S. PATENT DOCUMENTS 5,165,672 A 11/1992 Backman
5,188,349 A 2/1993 Honegger
5,269,504 A * 12/1993 Backman ..... 270/52.2

FOREIGN PATENT DOCUMENTS

EP 0448679 10/1991
EP 0536514 4/1993

* cited by examiner

*Primary Examiner*—Gene Crawford
*Assistant Examiner*—Leslie A Nicholson, III
(74) *Attorney, Agent, or Firm*—Rankin, Hill & Clark LLP

(57) ABSTRACT

Flat articles are inserted into printed products (3) continuously conveyed by grippers (11) of a gripper conveyor (1), wherein the printed products are held by the grippers at their fold or spine edges and wherein the grippers (11) are conveyed through a deflection region from below round an essentially horizontal deflection axis (2). Pegging elements (4) rotating around the deflection axis (2) are arranged along both sides of the deflection region and synchronized with the grippers, and form axially aligned and inter-spaced pairs and are radially distanced from the grippers. The printed products (3) are conveyed in a hanging manner into the deflection region and they are opened immediately upstream of the deflection region. The pegging elements (4) are activated as the grippers (11) enter the deflection region to grab the trailing part (32) of one opened printed product (3) and the leading part (31) of the next product by the corners opposite the fold or spine edge by clamping them together until the grippers (11) exit the deflection region.

12 Claims, 3 Drawing Sheets

METHOD AND DEVICE FOR INSERTING FLAT ARTICLES INTO PRINTED PRODUCTS

BACKGROUND OF THE INVENTION

1. Field of the Invention

The invention lies in the field of conveying and processing printed products and concerns a method and an installation according to the generic terms of the corresponding independent claims. The method and installation serve the insertion of flat articles into continuously conveyed printed products. The printed products are e.g. newspapers, periodicals or brochures, i.e. folded or bound printed products, which are opened for the purpose of insertion. The flat articles can be further printed products (e.g. folded or bound supplements, postcards, leaflets) or other articles (e.g. CDs, sample sachets) and, into each printed product, one article is inserted or a group of articles, which group is manageable as a single unit (plurality of similar or different flat articles).

2. Description of Related Art

According to the state-of-the-art technology, printed products are opened and flat articles inserted therein by supplying then e.g. to a rotating insertion drum, where they are held open in V-shaped compartments and are shifted in axial direction simultaneously with the rotation. Thus, they are conveyed past one supply point with each rotation of the drum. At each supply point a flat article is inserted, usually from above, into each passing printed product so that by the effect of gravity the article is driven towards and positioned adjacent to the inner side of the fold or spine edge of the printed product. The insertion drum is a large and highly sophisticated installation, whose use is really only justified when several supply points are necessary, i.e. when a plurality of different flat articles is to be inserted into each printed product and the plurality of these articles can not or ought not to be handled as one unit.

For inserting into each opened printed product just one flat article or a group of articles handled and inserted as one unit, simpler installations are more suitable, e.g. the installation described in the publication EP-0448679 (or U.S. Pat. No. 5,165,672, Wamac). This installation comprises rotating V-shaped compartments, in which the printed products are opened and conveyed past a supply point, where the flat articles are inserted. As the printed products in the V-shaped pockets do not have to be shifted transverse to the main conveying direction as they would be in the insertion drum, they do not need to be transferred to a means of conveyance equipped for this transverse motion, but, for the insertion, can remain in the grasp of the same grippers by which they are conveyed into, and retrieved from the rotary system comprising the compartments. To this purpose each compartment comprises two section and the grippers of the gripper conveyor are conveyed between these sections and aligned with their base along a part of the compartment rotation. As the printed products held in the compartment by the grippers approach the supply point, they are opened and held open while being conveyed past the supply point. The grippers are also temporarily opened during this conveyance past the supply point. In order to keep the printed products open in the V-shaped compartments and to maintain the position of their fold or spine edge in the gripper while the latter is open, the compartments are furnished with clamping means and are conveyed past the supply point in an essentially straight and horizontal line (with the opening facing upwards).

The installation according to EP-0448679 is simpler than an insertion drum, yet is still rather elaborated. Furthermore, it comprises the disadvantage that the grippers, which convey the printed products into the compartments, within the compartments past the supply point and then out of the compartments, must be spaced from each other such that the insertion procedure is possible during a straight lined, horizontal conveyance. This however is not the case for gripper of gripper conveyors as widely used for the conveyance of printed products, which grippers are usually spaced from each other by approximately 10 cm. An opening of no more than 10 cm is exceedingly narrow for the insertion of individual flat articles, particularly at high conveying speeds, and it is too small for the insertion of a group of articles. For an insertion using the installation disclosed in EP-0448679, the printed products must therefore be transferred to a special gripper conveyor with larger gripper spacing, which means further complexity of the installation and higher conveying velocity for the same capacity.

The object of the invention is to improve the method and installation according to the state-of-the-art technology for the insertion of flat articles is continuously conveyed printed products, i.e. the state-of-the-art technology as e.g. known from the publication EP-0448679, to the extent that they become simpler, and that they in particular can be used in conjunction with a commonly used gripper conveyor, i.e. with a gripper conveyor with a gripper spacing which is not large enough for the insertion according to EP-0448679.

This object is achieved by the method and the installation as defined in the claims.

BRIEF SUMMARY OF THE INVENTION

According to the invention, the supply point is positioned in a curved region of the gripper conveyor, where the gripper conveyor runs upward around an essentially horizontal deflection axis through a deflection of more than 90°, advantageously of approximately 180°. The grippers of the gripper conveyor convey the printed products suspended by their fold or spine edges toward the deflection. The printed products are opened in a conventional manner before they reach the deflection (advantageously immediately before the deflection), by separating a leading and a trailing product part from each other, such creating an opening opposite the fold or spine edge, wherein this opening, in the case of a conventional gripper conveyor, is too narrow for the insertion of a flat article.

Synchronised with, and axially and radially spaced from the grippers, axially aligned pairs of pegging elements rotate around the deflection axis on both sides of the gripper conveyor. These pegging elements are arranged and controlled in such a way that the two pegging elements of each pair grip and clamp the trailing part of one opened printed product and the leading part of the next in their corner regions opposite the fold or spine edge, and once such gripped, guide them around the deflection. As soon as the grippers enter the deflection, the pegging elements are activated, i.e. they are brought into a clamping configuration. On entering the deflection, each opened printed product is opened further because the radial distance of the pegging elements from the deflection axis is greater that that of the grippers, resulting in the pegging elements being further apart than the grippers when conveyed around the deflection. The opening of the printed products is therefore wide enough for the insertion even when a conventional gripper conveyor is used.

The supply point where the flat articles are inserted is located in the deflection, on or above the essentially horizontal plane which the deflection axis lies. Already during or immediately after insertion, gravity causes the inserted articles to drop towards the inside of the fold or spine edge of the printed product. At the supply point, or immediately thereafter, but while the corner regions opposite the fold or spine edge of the printed products are still held by the pegging elements, the grippers are temporarily opened so that the inserted articles are able to be positioned close to the fold or spine edge by gravity and so that the grippers when re-closed can clasp the inserted articles together with the printed products.

The pegging elements are deactivated, i.e. brought into a non-clamping configuration, at the latest, when the grippers exit the deflection and at the earliest after re-closing of the grippers.

It shows that it is quite sufficient to hold the leading and trailing corners opposite the fold or spine edge of the two parts of the opened printed products while the grippers are temporarily opened, regardless of whether this is the case already during or not until after the insertion. There is no need for any other support or clamping of the printed products. Although the fold or spine edge may move slightly within the opened grippers, particularly at high conveying speeds, the method is not affected.

The installation according to the invention co-operates with a direction change or deflection of the gripper conveyor, wherein the gripper conveyor advantageously comprises minimal distances between grippers and wherein the orientation of the grippers in relation to the conveyor remains fixed during the deflection (no pivoting caused by gravity). The deflection axis is essentially horizontal, the gripper conveyor turns upward from below and the deflection radius is as small as possible. The installation comprises the following components:

- A supply point equipped in a conventional manner for the delivery and insertion of the flat articles, wherein the supply point is situated on or above the essentially horizontal plane in which the deflection axis lies;
- A plurality of pegging elements, which rotate in synchronism with the grippers around the deflection axis on both sides of the gripper conveyor and at an axial distance therefrom and at a radial distance from the grippers. The pegging elements form axially aligned pairs, the distances between the pairs being adjusted to the gripper spacing and the radial distance from the deflection axis being larger for the pegging element pairs than for the grippers;
- Means for opening the printed products being conveyed by the gripper conveyor in a suspended manner towards the deflection, wherein these opening means are advantageously positioned immediately upstream of the entrance of the grippers into the deflection;
- Control means for opening and re-closing the grippers during conveyance through the deflection;
- and control means for activating and de-activating the pegging elements.

The particular advantages of the method and the installation according to the invention over conventional methods and installations serving the same purpose are the facts that the means by which the printed products are held in a manner suitable for the insertion of the flat articles and for the temporary opening of the grippers are considerably simpler (two pegging elements gripping corner regions of the product parts as opposed to two-part V-shaped compartments equipped with gripping means), and that, due to the supply point location in the region of the deflection, the grippers can be spaced considerably closer together on the gripper conveyor, i.e. that a conventional gripper conveyor can be used and the printed products do not need to be transferred to a special gripper conveyor for the insertion. As will be shown, the installation can also be very easily adjusted to be able to handle printed products of differing formats and it can equally easily be set into an inoperative mode permitting a normal, completely unimpeded use of the gripper conveyor (without insertion).

BRIEF DESCRIPTION OF THE DRAWINGS

The method according to the invention and an exemplary embodiment of the installation according to the invention are described in connection with the following Figs., wherein:

(FIG. 2: viewed transverse to the conveying direction; FIG. 3: section transverse to the conveying direction in the region of the deflection entrance);

(FIG. 4: viewed transverse to the conveying direction; FIG. 5: section transverse to the conveying direction in the region of the deflection entrance).

DETAILED DESCRIPTION OF THE INVENTION

Figure 1:
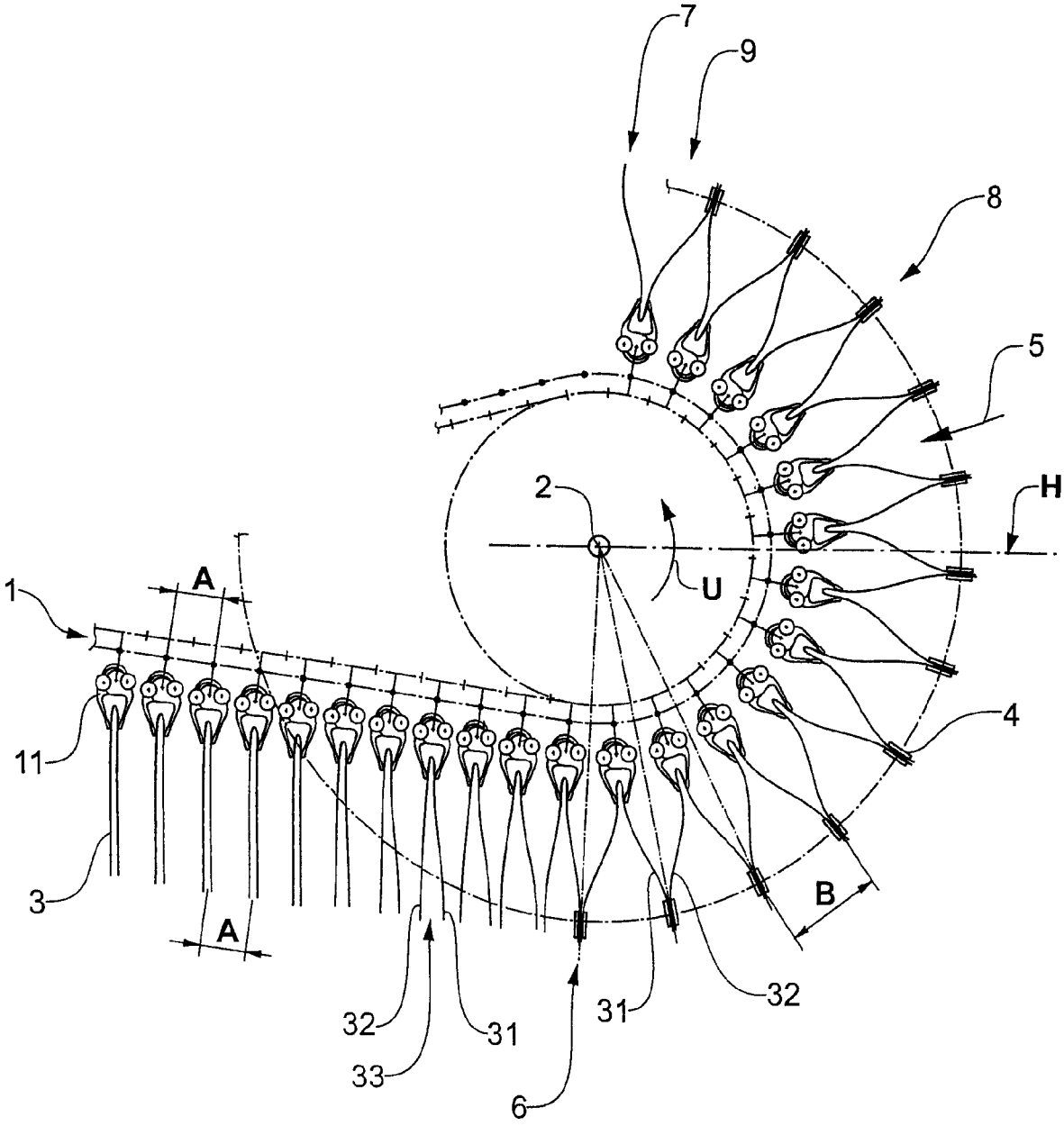
FIG. 1 shows the principle of the method according to the invention.

FIG. 1 shows the principle of the method according to the invention with the aid of a very schematic and incomplete illustration of the installation (viewed transverse to the conveying direction, i.e. in parallel with the deflection axis). Illustrated is the gripper conveyor 1 with grippers 11 running upward around the deflection axis 2 from below (arrow U), wherein the printed products 3 are held by the grippers 11 of the gripper conveyor 1 at their fold or spine edges and are conveyed into the deflection in a hanging position. Before the grippers 11 enter the deflection, the leading and trailing parts 31 and 32 of the printed products 3 are separated by an opening means (not shown) and the printed products are thus opened. At this point the opening 33 between the leading and trailing part of each printed product can obviously be no wider than the spacing A between the grippers.

Further illustrated are pegging elements 4 (only the pegging elements on one side of the gripper conveyor can be seen), rotating in synchronism with the grippers 11 around the deflection axis 2, wherein they move e.g. approximately midway between two successive grippers. The pegging elements 4 are radially distanced from the grippers 11, wherein this distance between grippers 11 and pegging elements 4 is adjusted to the height (when conveyed into the deflection essentially vertical and transverse to the conveying direction) of the opened printed products. The axial distance between the pegging elements of each pair is adjusted to the width (horizontal and transverse to the conveying direction) of the opened printed products.

The pegging elements 4 grasp the leading and trailing parts 31 and 32 of the opened printed products 3 separated by the opening means at the point where the grippers 11 enter the deflection, by clamping together the corner regions opposite the fold or spine edge of the trailing part 32 of one printed product and the corresponding corner regions of the leading part 31 of the next product. Upon entering the deflection each printed product 3 is opened further. As soon as both parts 31 and 32 have been clamped by a pair of pegging elements, the width of the product opening no longer corresponds with the gripper spacing A, but increases according to the radial distance between the grippers and pegging elements (B), thus rendering the opening wide enough for the insertion.

The supply point 5 (indicated by an arrow), to where the flat articles to be inserted (not shown) are supplied and where they are inserted into the printed products 3 conveyed around the deflection being held open by the pegging elements 4, is positioned on or above the essentially horizontal plane H in which the deflection axis 2 lies, i.e. in a position in which the opening 33 of the printed products 3 is at the same or advantageously at a higher level than the fold or spine edge of the product.

The pegging elements 4 are activated upon the grippers 11 entering the deflection (activation point 6). They are de-activated, at the earliest, downstream of the supply point 5 and, at the latest, when the grippers 11 exit the deflection (deactivation point 7). The grippers 11 are temporarily opened while the pegging elements are activated, i.e. they are opened upstream or downstream of the supply point 5 (exemplary opening point 8) and shut again downstream of the supply point 5 (exemplary shutting point 9).

For controlling the pegging elements 4 and the grippers 11 e.g. stationary control cams are provided and grippers 11 and pegging elements 4 are furnished with control rollers rolling along the cams. Exemplary cam and control roller combinations are shown generically in FIG. 2. A stationary control cam and control rollers on the grippers 11 is a control means 60 for opening the grippers temporarily, however other devices well known in the art may also be used. Stationary control cams and control rollers on the pegging elements 4 represents an activating device 61 for activating and de-activating the pegging elements, however other devices well known in the art may also be used.

Figure 2:
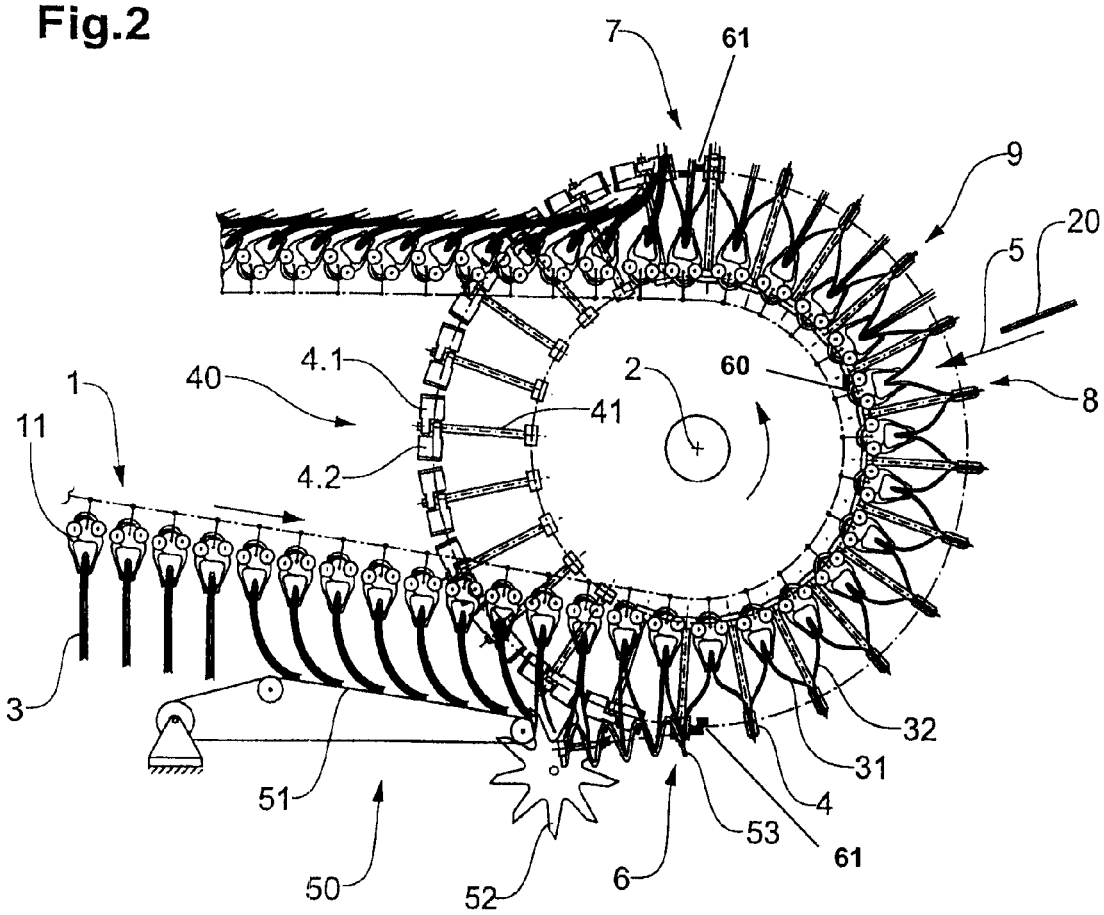
FIGS. 2 and 3 show an exemplary embodiment of the installation according to the invention in active mode
Figure 3:
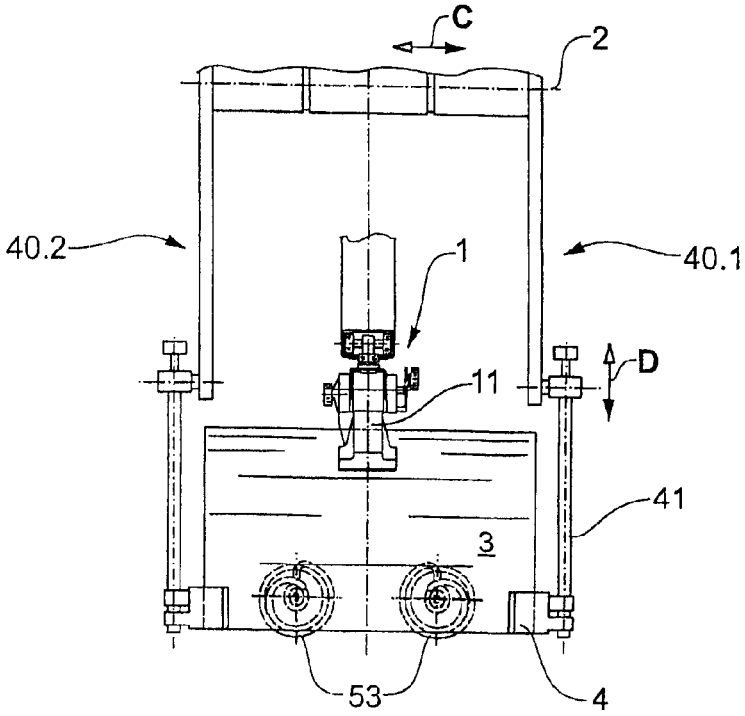

FIGS. 2 and 3 show an exemplary embodiment of an installation suitable for the insertion of flat articles 20 into open printed products 3 continuously conveyed past a supply point 5, as described in connection with FIG. 1. FIG. 2 shows the installation in the same way as FIG. 1, i.e. viewed transverse to the conveying direction (parallel to the deflection axis 2). FIG. 3 shows the region of the installation where the grippers enter the deflection, in an essentially vertical section parallel to the deflection axis 2. Identical elements are indicated with identical reference numbers. The installation component 40 bearing the pegging elements 4 and the opening means 50 are illustrated in more detail than in FIG. 1.

The installation component 40 is designed as a pair of mirror-inversed spoke wheels 40.1 and 40.2 positioned on either side of the gripper conveyor deflection, and rotating around the deflection axis 2, wherein each spoke 41 bears a pegging element 4. The two spoke wheels 40.1 and 40.2 are advantageously mounted upon the same axle as a pulley or chain wheel effecting the deflection of the gripper conveyor and are advantageously also driven by this axle. The axial distance between two aligned spokes, belonging to the spoke wheels 40.1 and 40.2, respectively, is greater than the width of the printed products to be handled and advantageously adjustable for handling printed products of different widths (double arrow C).

The pegging elements 4 each comprise two clamping jaws 4.1 and 4.2, wherein the jaws are arranged to pivot around the spoke 41, so that they are directed essentially parallel to the deflection axis 2 and pressed together when the pegging element 4 is in its activated configuration. When the pegging element 4 is de-activated, the jaws 4.1 and 4.2 are swung apart to such an extent that they do not come into contact with the printed products 3.

Advantageously, the radial length of the spokes 41 is adjustable (double arrow D) in order to adapt the installation to different heights of the printed products 3 to be handled. The pegging elements 4 can be shifted along the spokes 41 for the same purpose.

The opening means 50 comprises, in a per se known manner, an opening belt 51, an opening wheel 52 and an opening screw 53 and is particularly suitable for opening printed products with a jutting margin (leading part 31 reaches slightly lower than the trailing part 32, or vice-versa). The opening belt 51 is positioned below the gripper conveyor 1 and driven with slightly more velocity than the gripper conveyor 1 in such a manner that the lower regions of the printed products 3 are bent slightly forward. The opening wheel 52 is situated at the end of the opening belt 51 and comprises cogs reaching in between the leading and the trailing parts of the products. Adjacent to the opening wheel 52 is the rotating opening screw 53 comprising a pitch increasing in conveying direction and gathering the parts of adjacent printed products which have been separated by the opening wheel 52 and slightly expands the opening achieved by the opening wheel 52. At the exit of the opening screw 53, a pair of pegging elements clamps the gathered product parts 31 and 32 in the corner regions opposite the fold or spine edge. As evident from FIG. 3, it is advantageous to provide two parallel opening screws 53 of a mirror-inverted design, being driven in opposite directions.

It is obvious from FIG. 2 that the position of the grippers in relation to the conveying direction remains constant during conveyance through the deflection (non-pivoting grippers). Downstream of the deflection, i.e. when the printed products and the inserted articles are firmly held by the grippers and are no longer clamped by the pegging elements, the grippers may be released and returned to a gravity-dependent swivelling position in relation to the conveying direction.

Figure 4:
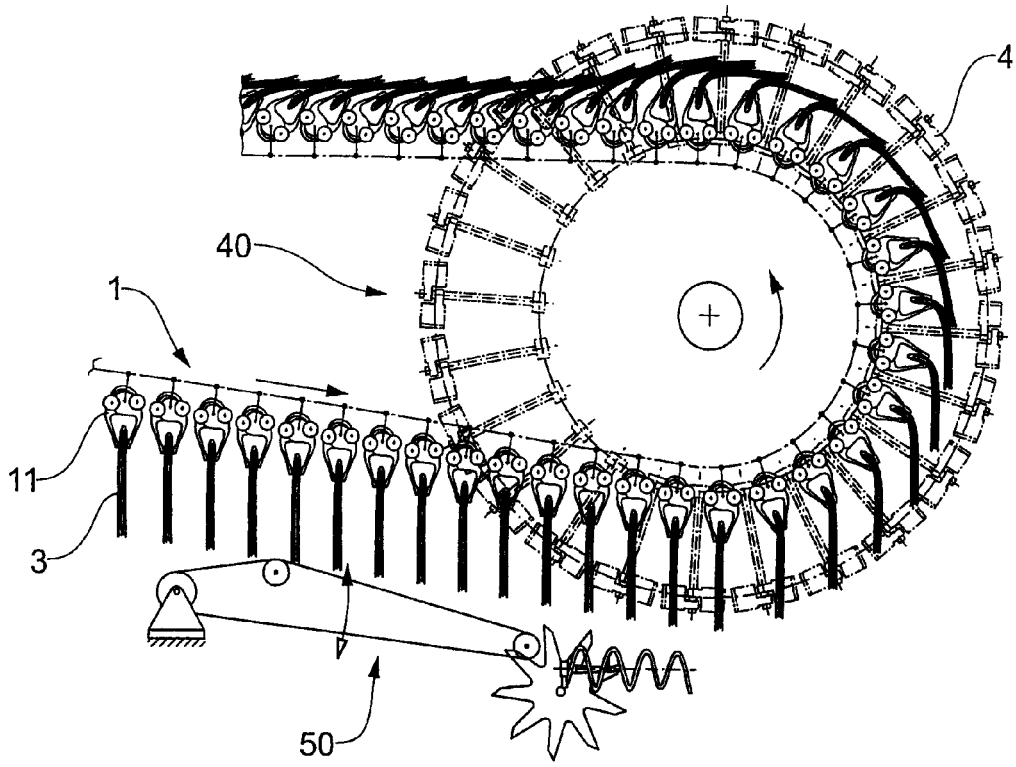
FIGS. 4 and 5 show the installation according to FIGS. 2 and 3 in an inoperative mode
Figure 5:
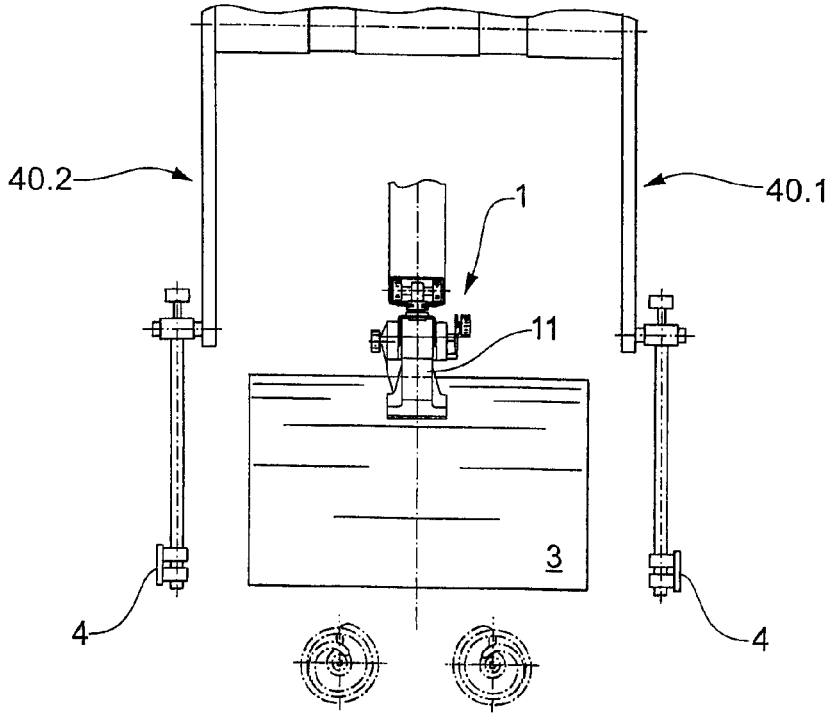

FIGS. 4 and 5 illustrate in the same manner as FIGS. 2 and 3 the installation in an inoperative state, i.e. in a condition permitting the printed products 3 to be conveyed by the gripper conveyor 1 through the deflection without being opened, without their leading and trailing parts being clamped by the pegging elements 4, without the grippers 11 being opened and without insertion of flat articles. Obviously, the supply of articles to be inserted needs to be stopped when the installation according to the invention is in this inoperative state. The opening means 50 needs to be moved downwards and possibly stopped and the two spoke wheels 40.1 and 40.2 are shifted apart axially to ensure that they are de-coupled from the drive and the pegging elements 4 do not interfere with the printed products 3, advantageously regardless of their configuration. The control of the grippers 11, for their temporary opening, is also to be switched off. Advantageously, the control cam controlling the temporary opening of the grippers is connected to one of the spoke wheels 40.1 or 40.2 and is withdrawn from the area of the gripper conveyor by the axial displacement of the spoke wheels, and therefore made inactive.

The above paragraph shows that it is very easy to switch the installation according to the invention as shown in FIGS. 2 to 5 into an inoperative state and back again into an operative state.

The invention claimed is:

1. A method of inserting flat articles (20) into continuously conveyed printed products (3) having a fold or spine edge, comprising the steps of:

holding the printed products (3) by a gripper (11) at their fold or spine edge;

conveying the printed products (3) to a supply point (5) and away from the supply point, wherein the printed products (3) are conveyed past the supply point (5) in an open state, each with a separated leading and trailing part (31 and 32), and the grippers (11) are temporarily opened in the region of the supply point (5), and supplying the flat articles (20) to the supply point (5), and inserting the flat articles (20) into the open printed products (3) and gripping the flat articles together with the printed products by the re-closed grippers (11), wherein the supply point (5) is located in a region in which the grippers (11) are deflected by being conveyed around an essentially horizontal deflection axis (2), around which the grippers (11) are conveyed upward from below, such that the printed products (3) being conveyed to the deflection region and being held by the grippers (11) in a hanging manner are opened before the grippers (11) enter the deflection region, and that during conveyance through the deflection region the trailing part of each (32) printed product and the leading part (31) of the following product are held clamped together in corner regions opposite the fold or spine edge.

2. The method according to claim 1, wherein the printed products (3) are solely held in said corner regions while the grippers (11) are temporarily opened.

3. The method according to claim 2, wherein the supply point (5) is positioned on or above an essentially horizontal plane (H), in which said deflection axis (2) lies.

4. The method according to claim 1, wherein the supply point (5) is positioned on or above an essentially horizontal plane (H), in which said deflection axis (2) lies.

5. The method according to claim 1, wherein, during conveyance thorough the deflection region the trailing part of each printed product and the leading part of the following product are held clamped to each other by a pair of axially aligned pegging elements.

6. An installation for inserting flat articles (20) into printed products (3) having a fold or spine edge, which installation is positioned in a region of a gripper conveyor (1) comprising grippers (11) suitable for continuous conveyance of the printed products (3) being held at their fold or spine edges, the installation comprising:

a means (50) for opening the printed products (3), a control means (60) for opening the grippers (11) temporarily, and a supply point (5) for supplying and inserting the flat articles (3) into the opened printed products (3), wherein the installation is positioned in a region of a deflection of the gripper conveyor (1), by which deflection the gripper conveyor (1) is deflected upwards around an essentially horizontal deflection axis (2) from below, wherein the means (50) for opening the printed products is located upstream of the deflection region, and wherein the installation further comprises a plurality of pegging elements (4), which are driven to rotate in axially aligned pairs and in synchronism with the grippers (11) around the deflection axis (2), the axial distances of the pegging elements (4) of each pair being adjusted to a width of the printed products (3) and the radial distances between grippers (11) and pegging elements (4) to a radial height of the printed products (3), so that each pair of pegging elements (4) is capable to grip by clamping together a trailing part (32) of one printed product opened by the means (50) for opening the printed products and a leading part (31) of the following printed product in the corner regions opposite the fold or spine edges, and wherein an activating device (61) for controlled activation of the pegging elements (4) activates the pegging elements (4) as the grippers (11) enter the deflection and de-activates them after the temporary opening of the grippers (11).

7. The installation according to claim 6, wherein the supply point (5) is located on or above a horizontal plane (H), in which the deflection axis (2) lies.

8. The installation according to claim 6, wherein the pegging elements (4) are mounted on spokes (41) of two spoke wheels (40.1 and 40.2) which are arranged one on each side of the deflection region of the gripper conveyor (1).

9. The installation according to claim 8, wherein each pegging element (4) comprises two clamping jaws (4.1 and 4.2) pivotable around the spoke (41), wherein, in an activated configuration of the pegging element (4), the jaws (4.1 and 4.2) are oriented axially and pressed against each other and wherein, on de-activation of the pegging element (4), the jaws (4.1 and 4.2) are swivelled apart.

10. The installation according to claim 8, wherein a radial length of the spokes (41) or a radial position of the pegging elements (4) on the spokes (41) is adjustable.

11. The installation according to claim 8, wherein the spoke wheels (40.1 and 40.2) are able to be shifted axially.

12. The installation according to claim 11, wherein the spoke wheels (40.1 and 40.2) are functionally connected with the deflection of the gripper conveyor (1) and that this connection is eliminated by shifting the spoke wheels (40.1 and 40.2).

* * * * *

UNITED STATES PATENT AND TRADEMARK OFFICE

CERTIFICATE OF CORRECTION

PATENT NO. : 7,802,780 B2
APPLICATION NO. : 11/577843
DATED : September 28, 2010
INVENTOR(S) : Mader et al.

It is certified that error appears in the above-identified patent and that said Letters Patent is hereby corrected as shown below:

In Column 7, Line 27, in Claim 5, delete "thorough" and insert -- through --

Signed and Sealed this
Twenty-fifth Day of January, 2011

David J. Kappos

David J. Kappos
*Director of the United States Patent and Trademark Office*